US005911588A

United States Patent [19]

Kern

[11] Patent Number: 5,911,588

[45] Date of Patent: Jun. 15, 1999

[54] ARRANGEMENT OF A RELAY ON A PLUG BASE

[75] Inventor: Josef Kern, Berlin, Germany

[73] Assignee: Siemens Aktiengesellschaft, Munich, Germany

[21] Appl. No.: 08/973,816

[22] PCT Filed: Jun. 5, 1996

[86] PCT No.: PCT/DE96/00992

§ 371 Date: Dec. 9, 1997

§ 102(e) Date: Dec. 9, 1997

[87] PCT Pub. No.: WO96/42099

PCT Pub. Date: Dec. 27, 1996

[30] Foreign Application Priority Data

Jun. 9, 1995 [DE] Germany ..... 195 21 133

[51] Int. Cl.[6] ..... H01R 13/52

[52] U.S. Cl. ..... 439/278; 29/622; 29/745; 29/747

[58] Field of Search ..... 439/278; 29/622, 29/745, 747

[56] References Cited

U.S. PATENT DOCUMENTS

| | | | |
|---|---|---|---|
| 4,675,779 | 6/1987 | Neuwirth | 439/278 |
| 4,743,210 | 5/1988 | Schild et al. | 439/559 |
| 4,961,713 | 10/1990 | McCracken et al. | 439/587 |
| 5,263,873 | 11/1993 | Landries | 439/278 |
| 5,280,410 | 1/1994 | Klinger et al. | 361/709 |
| 5,474,465 | 12/1995 | Kobayashi | 439/278 |
| 5,766,026 | 6/1998 | Cooper et al. | 439/76.1 |
| 5,789,920 | 8/1998 | Gass | 324/260 |

FOREIGN PATENT DOCUMENTS

| | | |
|---|---|---|
| 0 400 434 A1 | 5/1990 | European Pat. Off. . |
| 0 645 847 A2 | 9/1994 | European Pat. Off. . |
| 7 621 758 | 7/1976 | Germany . |
| 29 30 009 | 7/1979 | Germany . |
| 33 10 477 C2 | 3/1983 | Germany . |
| 40 33 963 A1 | 10/1990 | Germany . |
| 43 37 505 C1 | 11/1993 | Germany . |

*Primary Examiner*—Edgar Burr
*Assistant Examiner*—Charles H. Nolan, Jr.
*Attorney, Agent, or Firm*—Hill & Simpson

[57] ABSTRACT

In order to seal the plug-in region between a relay and a plug base, a peripheral sealing ring is integrally formed in one piece on the dimensionally stable plastic of one part using the two-component injection-molding process. The sealing ring is elastically deformed by latching elements which engage one in the other, thereby providing the desired sealing of the arrangement.

11 Claims, 4 Drawing Sheets

ARRANGEMENT OF A RELAY ON A PLUG BASE

BACKGROUND OF THE INVENTION

FIELD OF THE INVENTION

The present invention is directed to relays that are plugged into plug bases and, more specifically, to a combination relay and plug base whereby the connection between the relay and the plug base is waterproof and secure. In this context, relay is also understood to mean a so-called relay module, in which further circuit elements, such as resistors and diodes with the associated conductor tracks, are arranged in the housing in addition to the actual relay system.

A large number of possibilities have already been described for the sealing of relay housings, for example the potting of housing gaps with liquid and subsequently curable potting compound. It is also known (DE 43 37 505 C1) to coat wall regions between base or baseplate, on the one hand, and cap, on the other hand, with an elastomer layer using the two-component injection-molding process and thus to achieve the desired sealing when the housing parts are pressed onto one another.

If, however, a relay is inserted into a plug base, as is customary in motor vehicles, for example, then the plug connection between relay and plug base remains unprotected, even if the relay itself is sealed. Since such plug bases, particularly in the engine compartment of motor vehicles, are frequently exposed to severe fouling or moisture, it has been customary to date to insert additional sealing rings between relay and plug base in order to protect the plug connection.

EP 0 400 434 B1 furthermore discloses, for the connection of an electrical module, in particular of a relay, using an additional encasing housing, into which the relay is inserted. The encasing housing has a seal on two sides, namely, on the one hand, in the region of the plug connection, where a radial seal is provided in a region of overlap between plug base and encasing housing, and, on the other hand, on the opposite, open housing side, where a closure cover is tightly inserted by means of a sealing ring that is introduced. However, such an encasing housing causes a considerable additional outlay in terms of production and materials, quite apart from the large space requirement.

SUMMARY OF THE INVENTION

An object of the present invention is to provide a simple seal between a plug-in relay and the associated plug base, the seal requiring only slight structural changes and managing without additional individual parts, such as sealing rings and the like, during plug-in mounting.

According to the invention, this aim is achieved in that at least one of the two housings is composed of a dimensionally stable thermoplastic and, in an edge zone which faces the other housing and encloses the plug pins and plug-in openings, carries a sealing ring made of an elastomer and integrally formed in one piece, and in that the two housings are connected to one another in a positively locking and/or force locking manner by means of wall elements engaging one over the other, with elastic deformation of the sealing ring.

Since the housing caps of such relays and also the housings of plug holders are generally produced from a dimensionally stable thermoplastic material in any case, the additional integral forming of a thermoplastic, elastomeric sealing ring using the two-component injection-molding process causes only a slight additional outlay in terms of production. The respective other housing, in other words the one which does not carry the sealing ring, remains completely unchanged in any event. If the sealing ring is integrally formed on the plug base, the cap of the relay housing could even be composed of metal.

Depending on the individual conditions, the sealing ring may either be integrally formed on the relay cap and form its lower edge, or it may be recessed into the planar top side of the plug base opposite the edge of the relay cap. Alternatively, said ring may be integrally formed as a radial seal in the region of overlap between plug base and relay cap on one or the other part.

In an embodiment, the combination relay/plug base includes a relay with a relay housing which includes a bottom side from which a plurality of plug pins project to connect the relay housing to the plug base and the plug base also comprises a housing with a top side having a plurality of plug openings for accommodating the plug pins of the relay. The bottom side of the relay housing and the top side of the base housing engage each other at a common edge zone which encloses the plug pins of the relay that are received in the plug openings of the base. The edge zone accommodates a sealing ring which engages both the relay housing and the base housing to provide a sealed enclosure of the plug pins and plug openings. The relay housing and the base housing are positively connected to one another by cooperating locking wall elements which result in an elastic deformation of the sealing ring.

In an embodiment, the relay housing includes a cap structure which encloses the bottom side of the relay housing and has a lower edge. The sealing ring is integrally formed on the lower edge of the cap in one piece and the cap is latched onto the base with cooperating latching elements on the cap and the base which causes the sealing ring to be deformably pressed between the edge of the cap and the top of the base housing.

In another embodiment, the relay housing also includes a cap on the top side of the base housing which includes a recess which surrounds the plug opening. The sealing ring is injection-molded into the recess and, when the cap is latched onto the base housing, the lower edge of the cap is pressed into the sealing ring thereby providing a sealed connection with protects the plug pins and plug openings from the environment.

In an embodiment, the sealing ring is injection molded in one piece into the edge zone disposed between the cap of the relay and the top side of the base housing.

In an embodiment, the sealing ring is injection-molded in one piece onto the top side of the base housing.

In an embodiment, the base housing is further characterized as including an upwardly protruding collar that mateably receives the bottom side of the relay housing when the relay is connected to the base. A sealing ring is injection-molded in one piece into the bottom side of the relay housing and is deformably pressed between the bottom side of the relay housing and the top side of the base when the relay and plug base are connected together.

In an embodiment, the top side of the base housing comprises an upwardly protruding collar and the relay housing comprises a cap with a downwardly protruding lower edge. The lower edge of the cap is matably received within the collar of the base housing and the sealing ring is injection-molded in one piece onto an inside wall of the collar of the base housing and provides a sealing engagement between the cap of the relay housing and the collar of the plug base housing.

BRIEF DESCRIPTION OF THE DRAWINGS

The invention is explained in more detail below using exemplary embodiments with reference to the drawings, in which.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
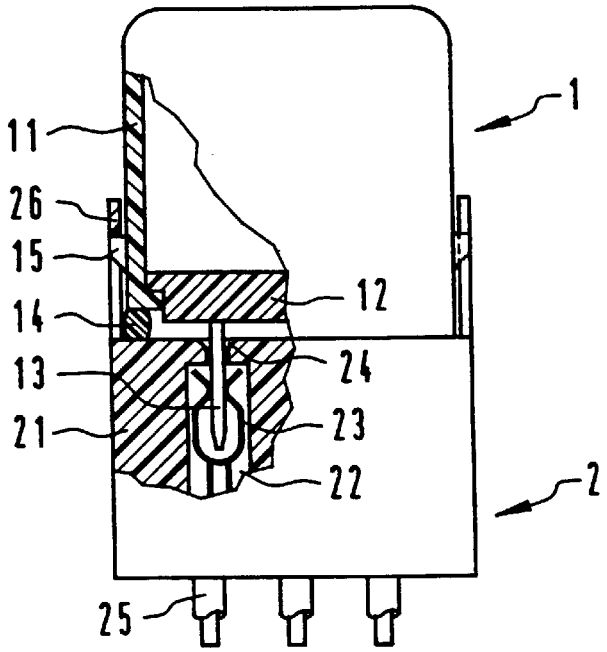
FIG. 1 is an elevational partial-sectional view of a relay housing with a plug base made in accordance with the present invention.
Figure 2:
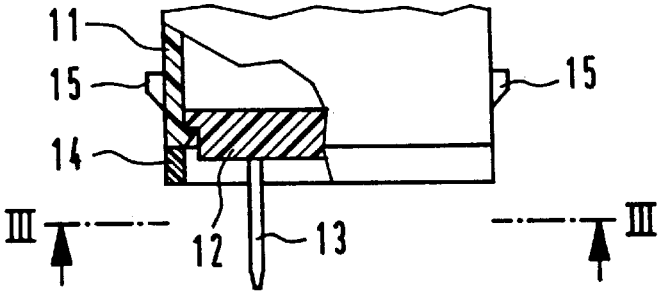
FIG. 2 is an enlarged partial-sectional view of the relay housing and plug base shown in FIG. 1.
Figure 3:
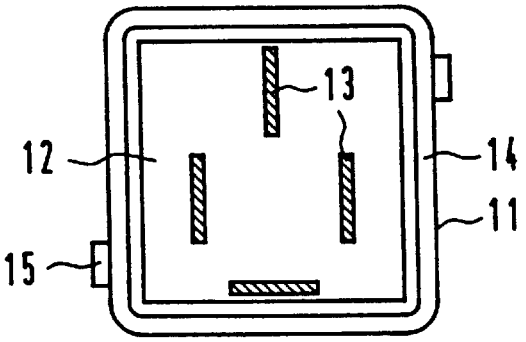
FIG. 3 is a sectional view taken substantially along line III—III of FIG. 2.

FIG. 1 shows the arrangement of a relay 1 on a plug base 2. The relay has a housing having a housing cap 11 and a baseplate 12, in which plug pins 13 are anchored. These plug pins are designed as blade terminals, as is evident in FIG. 3.

The plug base 2 has a housing 21 having chambers 22 in which plug sockets 23 are arranged. The chambers 22 open to the top side of the housing 21 in plug-in openings 24, through which the plug pins 13 of the relay are introduced. Connecting wires 25 are passed out at the underside of the housing 21, which wires are connected to the plug sockets 23 in the interior in a manner that is not illustrated.

In order to seal the plug connection between the relay 1 and the plug base 2, a sealing ring 14 in the form of a web is integrally formed on the housing cap 11, to be precise on the lower edge thereof. This sealing ring 14 is composed of an elastomeric thermoplastic, while the housing cap 11 is otherwise composed of a dimensionally stable thermoplastic. In this way, it is possible to produce the housing cap with the sealing ring in one piece using a two-component injection-molding process. In order to produce the necessary contact pressure on the sealing ring 14, the housing cap is additionally provided with latching lugs 15, which latch into retaining tabs 26 of the plug base. As can be seen in FIG. 1, the sealing ring 14 is elastically deformed by this latching, thereby producing the desired sealing of the two housings.

Figure 4:
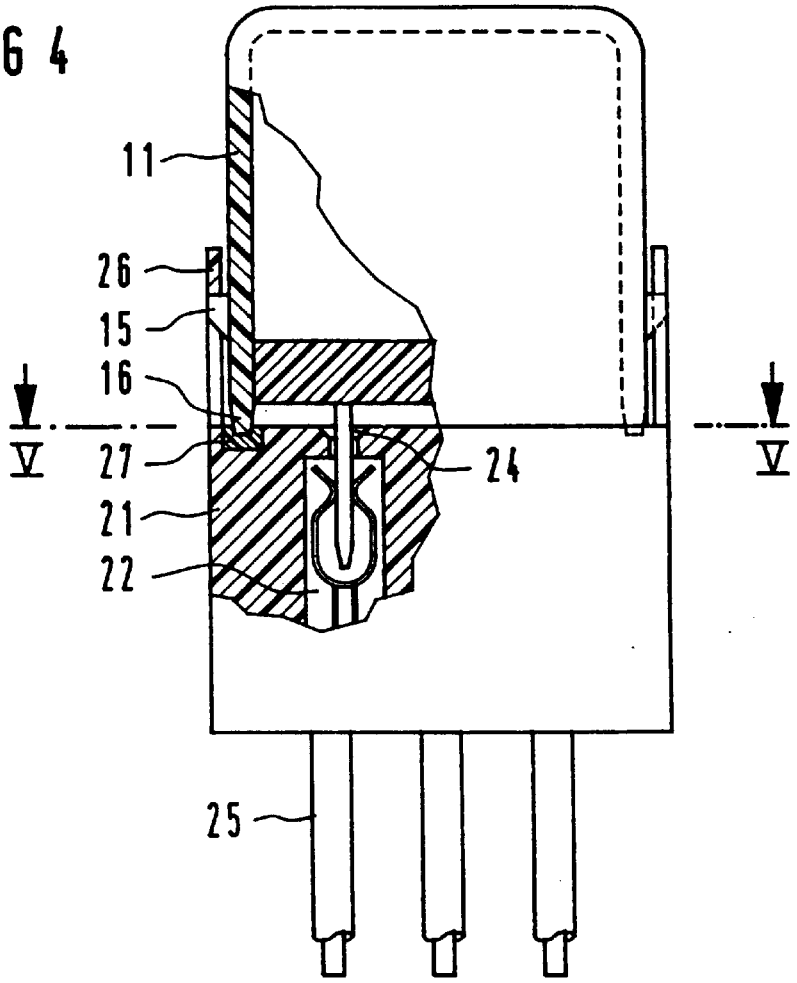
FIG. 4 is an elevational partial-sectional view of a second embodiment of a relay housing and plug base made in accordance with the present invention.
Figure 5:
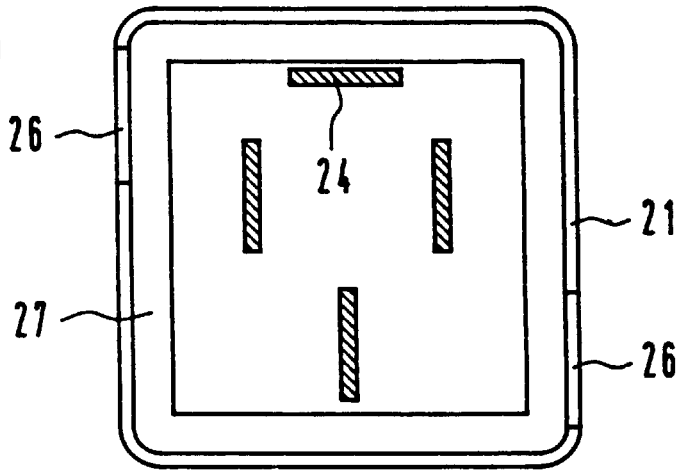
FIG. 5 is a sectional view taken substantially along line V—V of FIG. 4.

A modified embodiment is shown in FIGS. 4 and 5. The structure of the relay 1 and of the plug base 2 is largely the same as in FIG. 1. However, the sealing is effected in a complementary manner in this case. Instead of the sealing ring 14 on the relay cap, a sealing ring 27 is now injection-molded in a recessed manner into the planar top side of the plug base housing 21. The lower edge 16 of the housing cap 11 is forced into the sealing ring 27 by the latching of the latching lugs 15 in the retaining tabs 26, thereby achieving the desired sealing.

Figure 6:
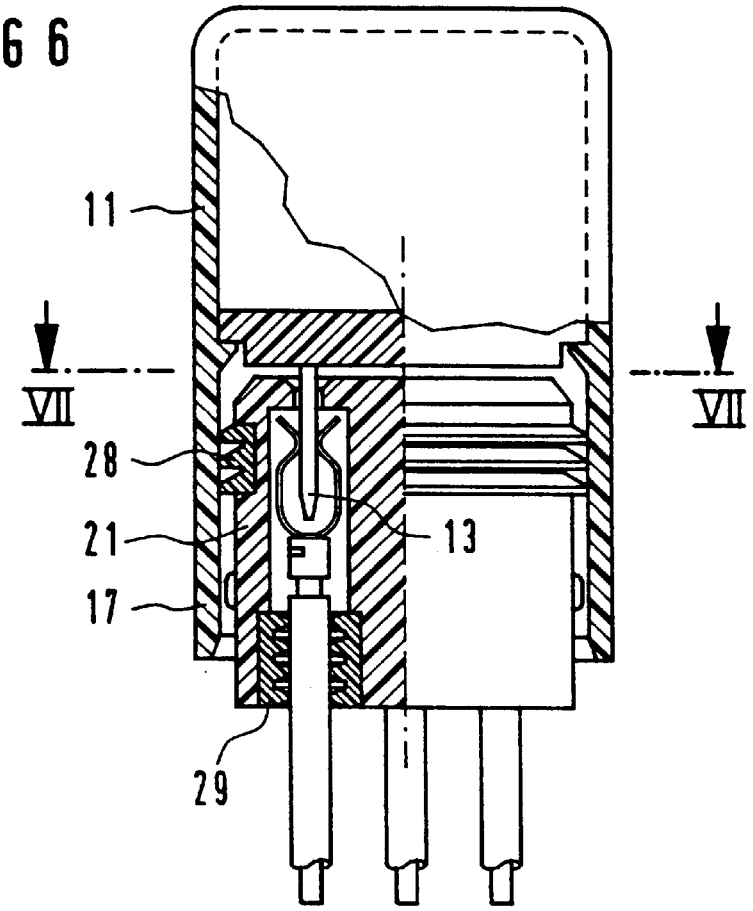
FIG. 6 is an elevational partial-sectional view of a third embodiment of a relay housing and plug base made in accordance with the present invention.
Figure 7:
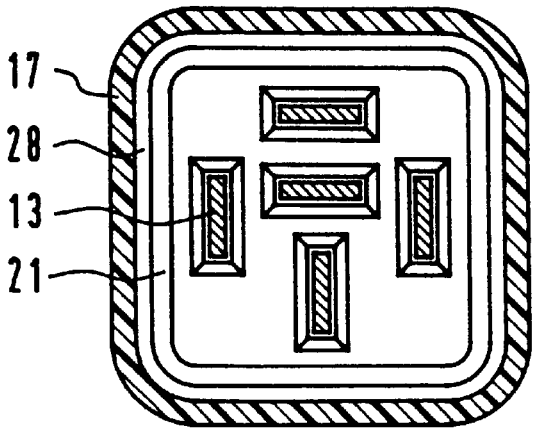
FIG. 7 is a sectional view taken substantially along line VII—VII of FIG. 6.

FIGS. 6 and 7 show a further modification. In this case, the relay cap 11 includes a collar 17, which is integrally formed downwards, over the base housing 21, which carries a radial sealing ring 28 which is injection-molded in a peripheral manner into a depression in the side wall. The elastic deformation of the sealing ring 28 is produced by the force-locking fitting of the collar 17 onto the base housing 21. FIG. 6 also shows, by way of suggestion, that annular seals 29 are provided in the base housing 21 for the tight lead-through of each of the connecting wires 25. These annular seals 21 can be integrally formed in one piece on the base housing 21 using a two-component injection-molding process in the same way as the radial sealing rings 28.

Figure 8:
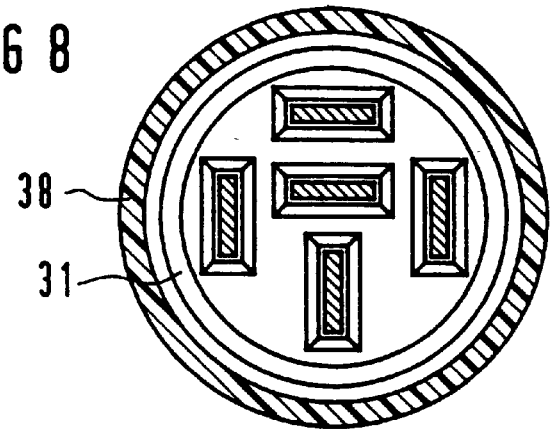
FIG. 8 is a sectional view of a fourth embodiment of a plug base made in accordance with the present invention.

FIG. 8 shows a plan view of a modified base housing 31, which can be provided with a radial seal, in this case with a sealing ring 38, in the same way as the rectangular housing shown in FIG. 7. This connector housing would be suitable for a relay which likewise had a correspondingly round cross section.

Figure 9:
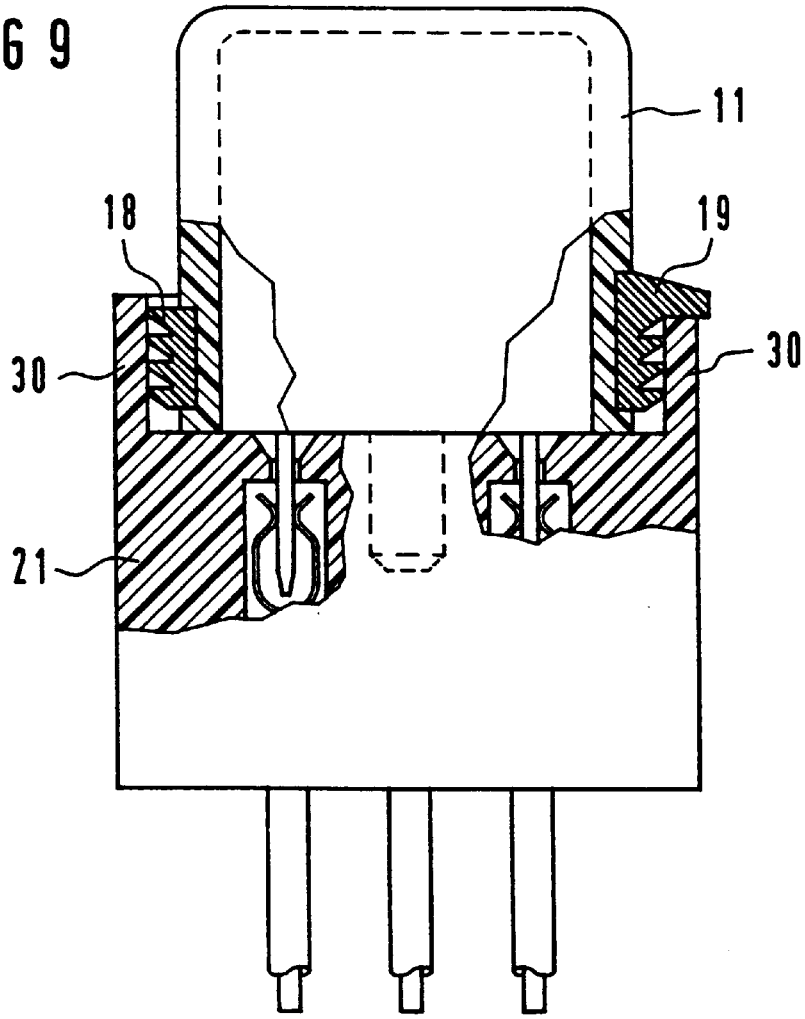
FIG. 9 is an elevational partial-sectional view of a fifth embodiment of a relay housing and plug base made in accordance with the present invention.

FIG. 9 shows a further modification of a relayplug base arrangement similar to FIG. 6. In this case, the base housing 21 engages with a collar 30, which is integrally formed upwards over the cap 11 of the relay. A sealing ring 18 is provided in the region of overlap between the collar 30 and the cap 11, which sealing ring is in turn made of elastomeric material and connected in one piece to the relay cap 11 using the two-component injection-molding process. Instead of the sealing ring 18, as is shown on the left-hand side of the cap 11 in FIG. 9, it is also possible to use a sealing ring 19 in accordance with the illustration on the right-hand side of FIG. 9. This sealing ring 19 additionally engages in a roof-like manner over the upper edge of the collar 30 and thus prevents water or dirt from being able to settle in the gap between relay housing cap 11 and base collar 30. Both the relay 1 and the plug base 2 are otherwise constructed as in the rest of the examples.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

I claim:

1. A combination of an electrical component mounted onto a plug base, the combination comprising:

the component comprising a component housing, the component housing comprising a bottom side from which a plurality of parallel plug pins project to connect the component housing to the plug base, the component housing further comprising a continuous collar that extends past the bottom side of the relay housing and parallel to the plug pins, the collar housing an inside surface, the plug base comprising a base housing, the base housing comprising a top side with a plurality of plug openings for accommodating the plug pins of the component, the plug base further comprising an outer sidewall with a continuous recess disposed therein, the continuous recess of the sidewall being integrally connected to an injection molded continuous sealing ring, the collar of the relay housing matably receiving the base housing therein whereby the continuous sealing ring is deformably trapped between the recess of the sidewall of the base housing and the inside surface of the collar of the component housing, the relay housing and the base housing being positively connected to one another by cooperating locking wall elements resulting in an elastic deformation of the sealing ring.

2. The combination of claim 1 wherein the cap comprises at least one latching element, the base housing comprises at least one latching element, the latching elements of the cap and the plug base interlocking with one another to positively lock the component into the recess of the plug base and to press the inside surface of the collar into the sealing ring.

3. The combination of claim 1 wherein the relay housing is fabricated from dimensionally stable thermoplastic material.

4. The combination of claim 1 wherein the base housing is fabricated from dimensionally stable thermoplastic material.

5. A combination of an electrical component mounted onto a plug base, the combination comprising:

the component comprising a component housing fabricated from a thermoplastic material, the component housing comprising a cap which surrounds a bottom side of the component housing from which a plurality of parallel plug pins project to connect the component to the plug base, the plug base comprising a base housing, the base housing comprising a top side with a plurality of plug openings for accommodating the plug pins of the component the top side of the base housing comprising a collar that extends towards the component, housing and which is parallel to the plug pins, the cap comprising a continuous lower edge, the lower edge of the cap being integrally connected to a one-piece continuous sealing ring, the lower edge of the cap being matably received within the collar and engaging the top side of the base housing so that the lower edge of the cap and sealing ring surrounds the plug pins and plug openings and so that the collar of the top side of the base housing surrounds the lower edge of the cap, the relay housing and the base housing being positively connected to one another by cooperating locking wall elements resulting in an elastic deformation of the sealing ring between the lower edge of the cap and the top side of the base housing.

6. A combination of an electrical component mounted onto a plug base, the combination comprising:

the component comprising a component housing fabricated from a thermoplastic material, the component housing comprising a cap which surrounds a bottom side of the housing from which a plurality of parallel plug pins project to connect the component housing to the plug base, the plug base comprising a base housing, the base housing comprising a top side with a plurality of plug openings for accommodating the plug pins of the component, the cap comprising a lower edge, the top side of the base housing comprising a recess that surrounds the plug openings, the recess being integrally connected to a one-piece sealing ring, the top side of the base housing further comprising a continuous collar that extends towards the component housing and which is disposed parallel to the plug pins, the component housing and the base housing being positively connected to one another by cooperating locking wall elements resulting in an elastic deformation of the sealing ring between the lower edge of the cap and the recess of the top side of the base housing and resulting in the lower edge of the cap being matably received within the collar and the collar surrounding the lower edge of the cap.

7. A combination of an electrical component mounted onto a plug base, the combination comprising:

the electrical component comprising a component housing fabricated from a thermoplastic material, the component housing comprising a cap which surrounds a bottom side of the component housing from which a plurality of parallel plug pins project to connect the component housing to the plug base, the plug base comprising a base housing, the base housing comprising a top side with a plurality of plug openings for accommodating the plug pins of the component, the cap comprising a lower outer surface, the lower outer surface of the cap comprising a continuous recess, the recess being integrally connected to a one-piece sealing ring, the top side of the base housing comprises a collar disposed parallel to the plug pins and that matably receives the lower outer surface of the cap, the collar comprising an inside surface, the cap of the component housing engaging the top side of the base housing so that the inside surface of the collar of the base housing, the lower outer surface of the cap and sealing ring surround the plug pins and plug openings, the component housing and the base housing being positively connected to one another by cooperating locking wall elements resulting in an elastic deformation of the sealing ring between the lower outer surface of the cap and inside surface of the collar of the base housing.

8. A method of manufacturing an electrical component mounted onto a plug base, the method comprising the following steps:

providing a plug base comprising a base housing, the base housing comprising a top side with a plurality of plug openings, the base housing comprising an upwardly protruding and continuous collar, providing a component comprising a plurality of plug pins, injection molding a component housing from a thermoplastic material having a lower edge for being matably received within the collar of the plug base and injection molding a continuous sealing ring from an elastomeric material onto the lower edge of the component housing, inserting the component through the lower edge of the component housing so that the plug pins extend outward from the component housing, inserting the component housing and component into the collar of the plug housing so that the plug pins are received in the plug openings and the continuous sealing ring is deformably trapped between the lower edge of the component housing and the plug base.

9. A method of manufacturing an electrical component mounted onto a plug base, the method comprising the following steps:

providing a plug base comprising a base housing, the base housing comprising a top side with a plurality of plug openings, the base housing comprising an upwardly protruding and continuous collar with a continuous inside surface, providing a component comprising a plurality of plug pins, injection molding a component housing from a thermoplastic material having a continuous lower outer surface for being matably received within the collar of the plug base, the continuous lower outer surface having a continuous recess disposed therein, and injection molding a continuous sealing ring from an elastomeric material into the recess of the lower outer surface of the component housing, inserting the component through the lower edge of the component housing so that the plug pins extend outward from the component housing, inserting the component housing and component into the collar of the plug housing so that the plug pins are received in the plug openings and the continuous sealing ring is deformably trapped between the recess of the lower outer surface of the component housing and the inside surface of the collar of the plug base.

10. A method of manufacturing an electrical component mounted onto a plug base, the method comprising the following steps:

injection molding a base housing for a plug base from a thermoplastic material, the base housing comprising a top side with a plurality of plug openings, a continuous recess that surrounds the plug openings and an upwardly protruding and continuous collar that surrounds the recess, and injection molding a continuous sealing ring from an elastomeric material into the recess of the base housing, providing a component comprising a plurality of plug pins and a component housing having a lower edge for being matably received within the collar of the base housing, inserting the component housing and component into the collar of the plug housing so that the plug pins are received in the plug openings and the continuous sealing ring is deformably trapped between the lower edge of the component housing and the recess of the plug base.

11. A method of manufacturing an electrical component mounted onto a plug base, the method comprising the following steps:

injection molding a base housing for a plug base from a thermoplastic material, the base housing comprising a top side with a plurality of plug openings and a continuous outer wall with a continuous recess disposed therein, and injection molding a continuous sealing ring from an elastomeric material into the recess of the outer wall of the base housing, providing a component comprising a plurality of plug pins and a component housing having a lower collar for matably receiving the base housing therein, the lower collar having a continuous inside surface, inserting the component housing over the base housing and plug pins of the component into the plug openings so that the continuous sealing ring is deformably trapped between the inside surface of the collar of the component housing and the recess of the outer wall of the base housing.

* * * * *